United States Patent [19]

Simpson

[11] Patent Number: 4,622,778

[45] **Date of Patent: * Nov. 18, 1986**

[54] LATCH AND CORNER SUPPORT FOR PIVOTAL WINDOW SASH

[75] Inventor: Harold Simpson, Chicago, Ill.

[73] Assignee: Ashland Products Company, Chicago, Ill.

[ * ] Notice: The portion of the term of this patent subsequent to Apr. 1, 2003 has been disclaimed.

[21] Appl. No.: 759,901

[22] Filed: Jul. 29, 1985

[51] Int. Cl.[4] ..... E05D 15/22

[52] U.S. Cl. ..... 49/161; 49/180; 49/453; 49/175

[58] Field of Search ..... 49/161, 162, 181, 449, 49/453, 175, 180

[56] References Cited

U.S. PATENT DOCUMENTS 4,555,868 12/1985 Mancuso ..... 49/181

*Primary Examiner*—Kenneth Downey

*Attorney, Agent, or Firm*—Silverman, Cass, Singer & Winburn, Ltd.

[57] ABSTRACT

A window sash of a double-hung window assembly has framing members formed of extruded plastic material of one configuration providing a hollow formation extending therethrough and opening to the ends thereof. Support and connector members are installed internally of the framing members to form and rigidify the corner right angle butt joints therebetween. The support and connector members include internal latch means.

21 Claims, 9 Drawing Figures

FIG. 6
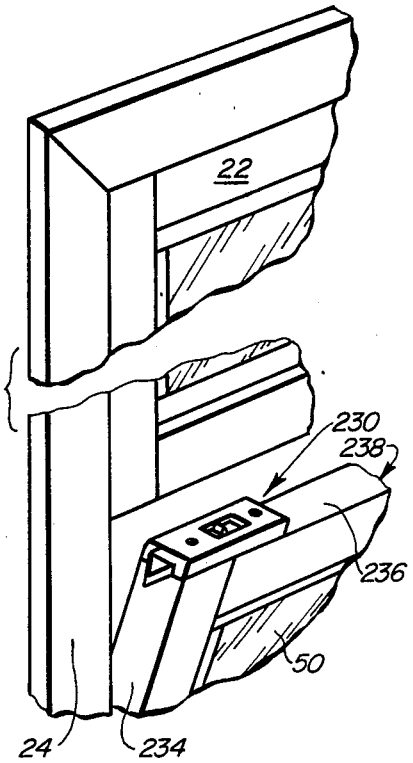
FIG. 7
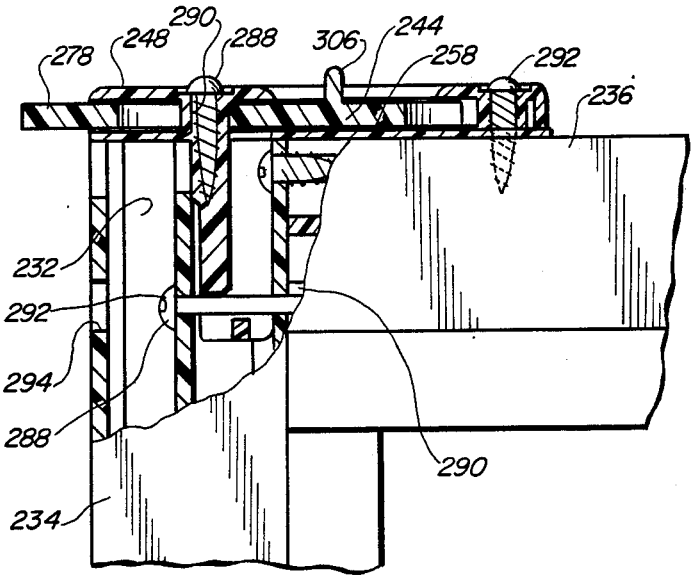
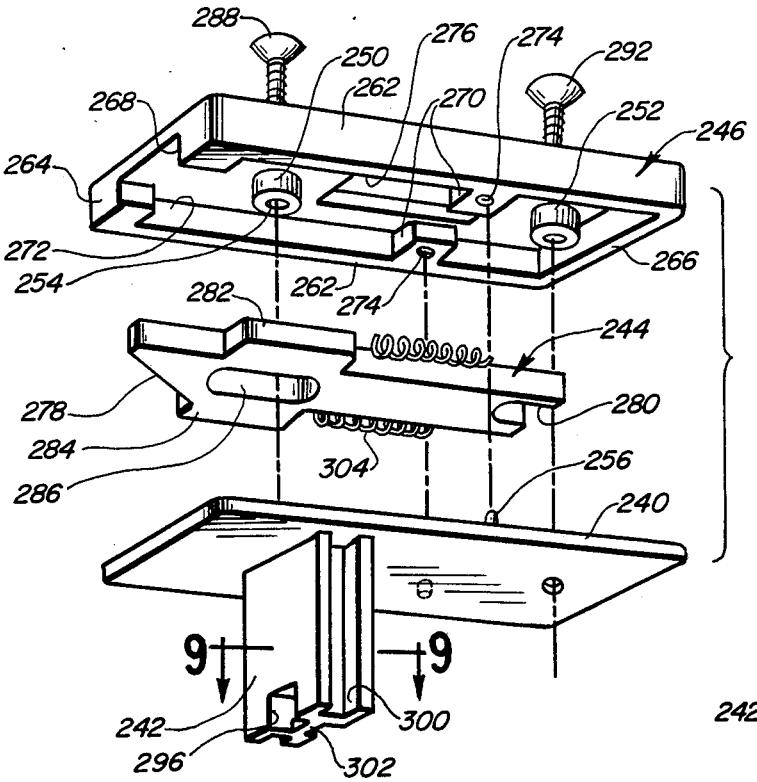
FIG. 8
FIG. 9
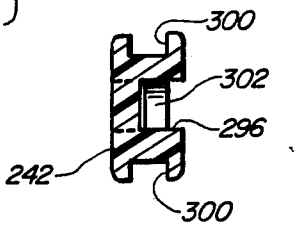

LATCH AND CORNER SUPPORT FOR PIVOTAL WINDOW SASH

CROSS-REFERENCES TO RELATED APPLICATIONS

The invention herein is an improvement of the general subject matter disclosed in my copending applications, Ser. Nos. 602,382, 602,386 (now U.S. Pat. No. 4,578,903) and 627,989 respectively filed Apr. 20, 1984, Apr. 20, 1984 and July 5, 1984 and entitled Corner Locking and Associated Pivot Means for Extruded Plastic Windows; Latch for Pivotal Sash Window; Combination Pivot Corner and Slide Guide for Sash Window, respectively, the disclosures of each being incorporated by reference herein and made a part hereof for the background and disclosure recited therein.

BACKGROUND OF THE INVENTION

This invention relates generally to a double-hung window assembly having pivotal sashes and more particularly, to an improved sash constructed from extruded plastic framing members having novel latching means associated therewith at the corner box or butt joints of the sash.

Known double-hung window assemblies provide for inward tilting or pivoting of the two sashes by means of rotating members at the bottom ends of the sash balance mechanisms. Normal vertical reciprocal movement of the sashes is maintained by latch mechanisms disposed at the top margins of the sashes. The latch mechanisms usually include some manner of latch bolts that can slide along guide rails extending vertically of the master frame jambs. Releasing the latch mechanisms permits the sash to be pivoted inwardly for cleaning and/or servicing of the window glass pane.

Recently, such window assemblies and sashes have been formed of extruded synthetic plastic. In U.S. Pat. No. 4,144,674, extruded plastic members of one, uniform, cross-sectional configuration are fabricated to form the master frame while extruded plastic members of another, uniform cross-sectional configuration are fabricated to form the frame of each sash. Each sash has two latching mechanisms fastened onto the top surface of the header and two pivot pins fastened onto the top surface of the header and two pivot pins fastened onto the bottom surface of the base. The sash frames have miter-jointed corners. Hollow configurations of the sash framing members function to provide insulation against heat loss through the sash frame.

Fabrication of such a frame occurs by inserting the four frame members in a jig and clamping them together until adhesive applied to the miter-joints sets. This requires waiting time for setting of the adhesive and perfectly joined corners is a very difficult and often inconsistent achievement. Often, the extruded members are slightly warped or mitered imperfectly so that mating end edges that are intended to abut fail to do so. The result is non-mating miter joint and edges that are readily discernible because of the slivers of light that can pass through the joint in a direction normal to the plane of the sash. Such slivers of light leakage signal air and heat leakage rendering the particular sash undesirable for use in a home or office where heating costs are important.

The completion of such a sash requires the addition of the latch mechanisms and pivot pins. Previously, the latch mechanisms were applied external of the sash header with a suitable covering or guiding plate, or if internal, in a groove of the header, with a similar covering or guiding plate to close the groove. These covers and/or grooves add to the cost of the sash.

More recently, the sash frame members have been joined together by combination internal members of the miter joints. See U.S. patent application Ser. No. 602,382 filed Apr. 20, 1984, now U.S. Pat. No. 4,578,903. That application discloses combination support and connector members having a pair of leg segments perpendicular to one another. Each leg has a cross-sectional configuration complementary to that of the sash frame members to facilitate installation of the combination member legs in the mating miter ends of the frame parts. The combination members then are secured to the frame members by fasteners such as screws.

Newly developed sash frames have box or right angle butt joints instead of miter joint corners. The sash frame members have longitudinal hollows therein, and when joined in box or butt joints, the hollows are exposed. Thus, it would be useful to provide latch mechanisms including portions that further serve to join the frame members together while closing off the open ends of the frame members.

SUMMARY OF THE INVENTION

The invention comprises a sash frame adapted to be installed in a double hung window assembly, the sash frame being formed of hollow, extruded plastic framing members with novel support and connector members installed internally of the framing members to form and maintain the right angle butt joints at the corners of the sash frame. Two of the support and connector members of each sash include latch means also installed internally in the framing members for maintaining the sash in a normal vertical position and reciprocal in the window assembly. The support and connector members facilitate fabrication of the sash frame, block light leakage through imperfect right-angle butt joints and simplify the latch means.

Each sash comprises a rectangular frame having a top header, two side stiles and a bottom base. The sash frame mounts desired glazing. The header, stiles and base are extruded from synthetic plastic material to a uniform cross-sectional configuration defined by a continuous hollow formation therethrough. The hollow formation opens to opposite ends of the header, stiles and base and the ends thereof are at right angle to mate with the adjacent extremities of the framing members, i.e. the header, stiles and base. The stiles have outer side walls through which two passageways are formed, each contiguous an end of the stile, so that the passageways open outwardly of the sash.

Each sash further comprises four combination support and connector members engaged in the adjacent opposite ends of the hollow formations of the header, stiles and base, to form and maintain the right angle butt joints at the corners of the frame. Each support and connector member has a pair of legs arranged perpendicular to one another and of cross-sectional configuration complementary to that of the hollow formation of the header, base and stiles to enable engagement of the legs therein. In the preferred embodiments, the support and connector members are mechanically fastened to the framing members, such as by screws or other suitable fasteners. The invention herein principally concerns the connections between the header and the two stiles.

Each support and connector member installed at the joint between the head and stiles includes latch means having a latch bolt extending through one of said passageways. The latch bolt is engageable with a guide rail of the master frame jamb, and is linearly movable for release from the guide rail from the exterior of the header selectively for pivoting of the sash.

Each support and connector member is installed in a close, complementary fit with the conjoined sash frame members to achieve a tight joint which prevents leakage of light therethrough from either of the opposite surfaces of the conjoined frame members.

BRIEF DESCRIPTION OF THE DRAWINGS

FIG. 6 is a fragmentary perspective view similar to that of FIG. 1 but illustrating an alternative embodiment of the invention installed thereon;

FIG. 7 is a fragmentary sectional view of the joint between the header and a stile showing the modified support and connector member with latch means;

FIG. 8 is an exploded perspective view of the support and connector member and the latch means of FIG. 7, and FIG. 9 is a sectional view taken along lines 9—9 of FIG. 8 and in the direction indicated by the arrows.

DESCRIPTION OF THE PREFERRED EMBODIMENT

Figure 1:
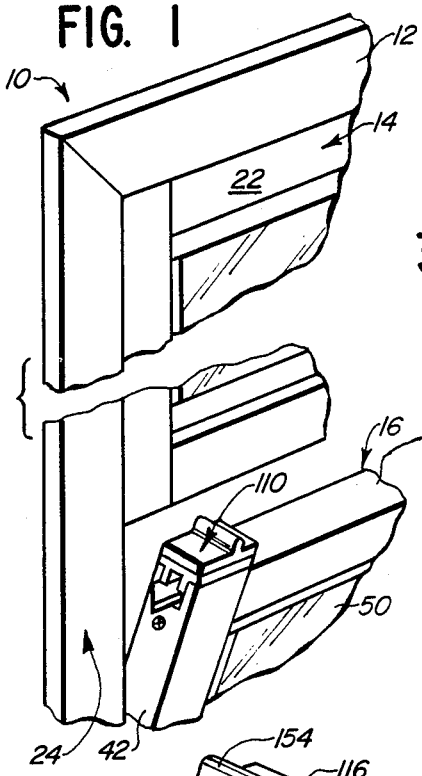
FIG. 1 is a fragmentary perspective view of a double-hung window assembly mounted in a wall and constructed and arranged for pivoting of the sashes inwardly, the sashes including the latch support and connector means embodying the invention, the lower sash being shown in pivoted condition.

Referring to FIG. 1, a double-hung window assembly incorporating the invention is indicated generally by the reference numeral 10. Assembly 10 is installed in wall (not shown) and comprises a master frame 12, two glazed sashes 14 and 16 and four sash balance mechanisms (not shown). Only a portion of the window assembly is illustrated as the invention herein relates to the latch and connector.

For explanation, it should be seen that the master frame 12 includes a top header 12, two side jambs 24 (only a fragment shown) and a sill (not illustrated). Header 22, jamb 24 and the sill are extruded of plastic material and joined together at their four corners to form a rectangular, i.e. four sides and four right-angled corners, master frame suitable for direct installation in a building wall opening. The jamb 24 is cut from extrusions having one cross-sectional configuration while header 22 is cut from extrusions having its own cross-sectional configuration, as desired for the particular master frame 12.

The jamb 24 has a configuration presenting two parallel and vertically extending channels 26 in which are operatively mounted the sash balance mechanisms (not shown). The sash balance mechanism in channel 30 operates to balance the inner lower sash 16 while the mechanism that would be mounted in similar vertical channels would operate to balance outer upper sash 14. Sash balance mechanisms (not shown) and their operative mounting are known. Jamb 24 presents vertical channels 26 which operatively mount two sash balance mechanisms (not shown).

The channel 26 and jamb 24 have interior edges that form vertically extending guide rails 30 and 32 that can be used to maintain the sashes vertically aligned for normal reciprocal movement in master frame 12.

Referring to FIG. 1, sashes 14 and 16 are of like construction and arrangement, and although they may differ in size, such as width, describing one is sufficient for describing the other. The lower sash is generally rectangular but can be a square, if desired. Sash 16, as illustrated fragmentarily, includes a top header 40, side stiles 42, a base (not shown) and glazing 50.

The sash parts are extruded from a suitable synthetic plastic to have a uniform cross-sectional configuration along their lengths defined by a hollow configuration opening to the ends or extremities thereof. In practice, an extruded length of desired cross-sectional configuration is cut into desired lengths forming the header 40, the base (not shown) and stiles 42. The ends of the header 40 and stiles 42 are right angle cut for cooperative abutting connection together in right angle joints at adjacent extremities thereof to form with the base (not shown), the retangular frame of the sash.

In particular, the end surface 52 of header 40 abuts flush with one right angle end surface 54 of stile 42. The other end surface of the stile likewise is right angle cut at about a 90 degree angle to abut flush with the similar end surface of the base. The four corners of the sash frame, thus, are defined by the butt joints. Theoretically, these joints are light proof by true flush abutting of perfectly cut end surfaces and properly configured extrusions. In reality, the extrusion, from which the header, base and stiles are cut, is warped and wavy and the ends are imperfect, resulting in voids between the supposedly abutting surfaces of the butt joint thereby allowing light to pass through the sash, as was discussed earlier.

Since the two joints at the left-hand side of sash 16 are mirror-image duplicates of those at the right-hand of the sash, a description of only the left-hand upper corner joint will need be described and is sufficient to describe all of the sash butt joints.

Figure 4:
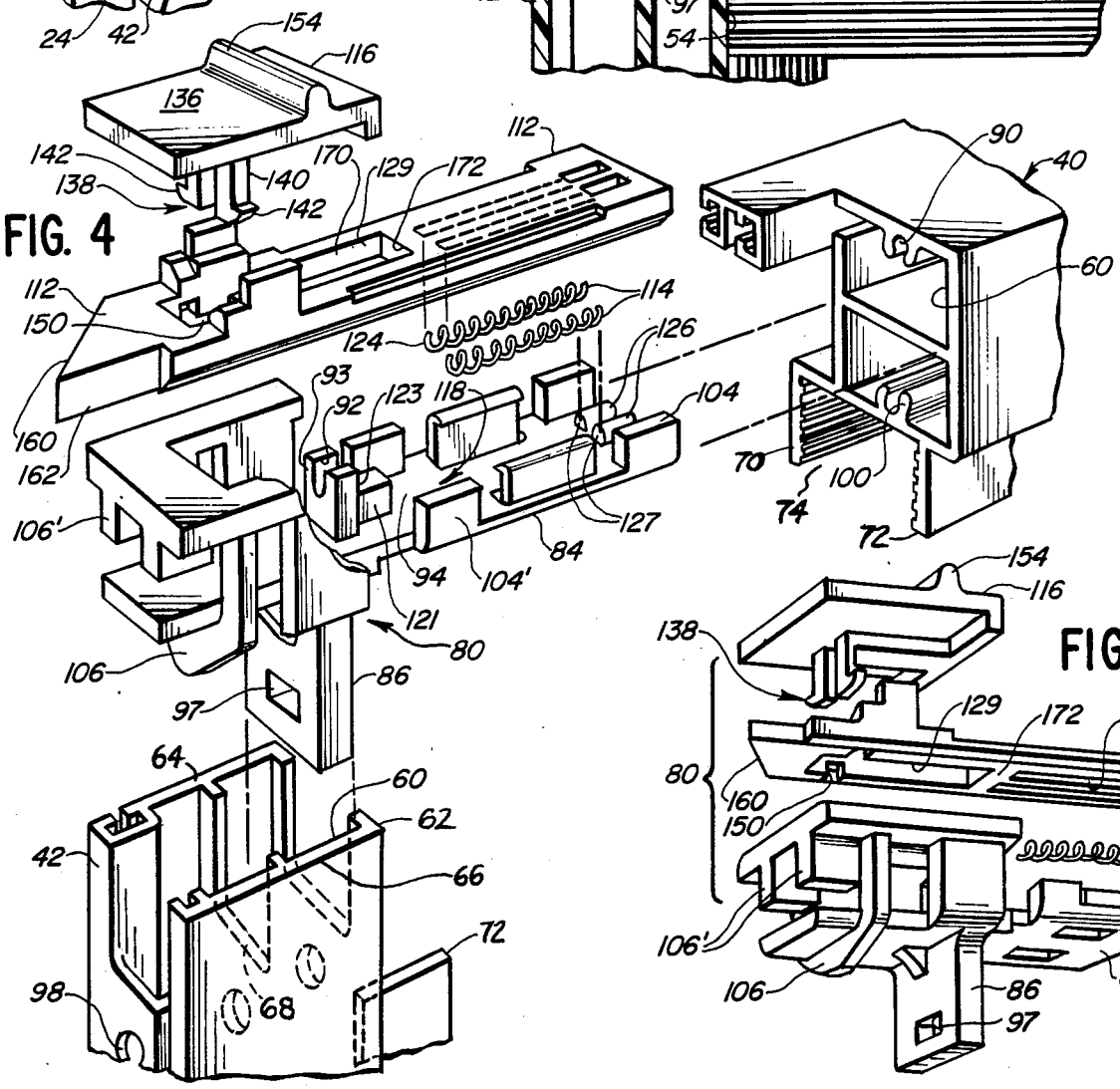
FIG. 4 is an exploded perspective view of the right angle butt joint between the header and a stile and showing a support and connector member with latch means.
Figure 5:
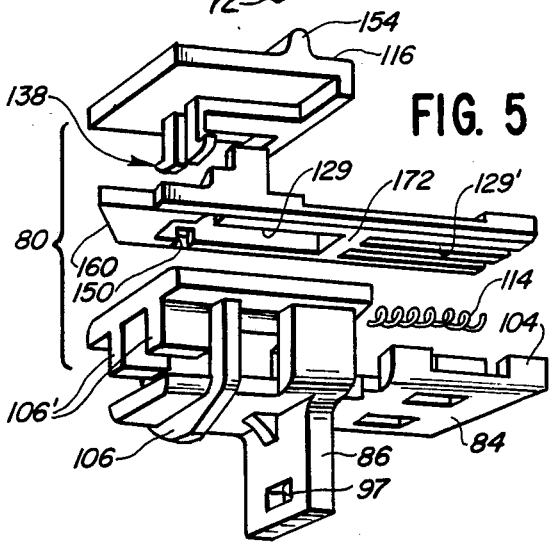
FIG. 5 is an exploded perspective view of the support and connector member with latch means shown in FIG. 4.

In FIG. 4, the cross-sectional configuration of stile 42 comprises a hollow formation 60 surrounded by an outer wall 62, side walls 64 and 66 and an inner wall 68. Two inwardly extending box-like sections 70 and 72 define a channel 74 (see header 40) receiving the peripheral margin of the glazing. This cross-sectional configuration is used for all of the header 40, the base and both stiles 42.

The problems of the prior miter jointed, extruded plastic member, fabricated sashes were overcome and stronger, simpler sashes were achieved by the provision of support and connector members (only one shown), respectively installed internal of the header 40 and stile 42, at the miter joint therebetween. The invention herein provides equal advantage for those constructions employing right angle butt joints instead of miter joints. The support and connector members are molded of plastic material.

Figure 3:
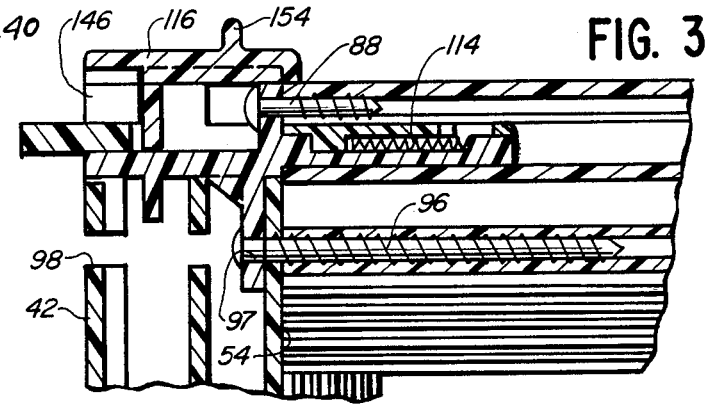
FIG. 3 is a fragmentary sectional view taken along line 3—3 of FIG. 2 and in the direction indicated by the arrows.

Connector member 80 is "L" shaped and has two leg segments 84 and 86 arranged perpendicular to one another. The cross-sectional configurations of the leg segments 84 and 86 are complementary to the hollow formations 60 of the header 40 and stile 42 for compatible and snug engagement therein. Thus, operatively engaged, leg segment 84 is completely internal hollow formation 60 of header 40, and leg segment 86 is completely internal hollow formation 60 of stile 42. Member 80 and header 40 are rigidly joined together by any fastener, such as a screw 88 passing through channel 90 in the outer wall of header 40 and into a top opening U-shaped channel 92 formed in portion 93 upstanding from a platform 94 of leg segment 84. Member 80 and stile 42 are rigidly joined together by any fastener, such as screw 96 (FIG. 3) passing through opening 98 in the outer wall of stile 42 and passage 91 in the depending leg 86, into threaded engagement with a "U"-shaped screw receiving flange 100. Member 80 includes upstanding rigidifying flanges 104 and depending rigidifying flanges 106 and 106' extending along the opposed longitudinal margins of the leg segments 84 and 86 so that the right angle butt joint formed with support and connector member 80 is strong, fixed and light blocking.

Fabrication of the right angle butt joint occurs by simply inserting the leg segments 84,86 of member 80 in the respective hollow formations 60 of the header 40 of the stile 42, fastening the parts together with two self-tapping screws 88 and 96 (for example). No jig or glue is needed and there is no time waiting for glue to set.

Beyond simplifying the construction of and rigidifying the right angle butt joint between the header 40 and the stile 42, support and connector member 80 also includes latch means that engages with one of guide rails of the side parts of the frame for maintaining sash 16 vertically aligned in master frame 12. Latch means 110 comprises a latch bolt 112, spring 114, an actuating slider with thumb slide button 116, and cooperating structure of member 80.

Latch bolt 112 is molded of plastic material to be plate-like and is dimensioned to be received in a channel 118 formed by platform 94 and upstanding and rigidifying flanges 105 for longitudinal reciprocal movement therein. Bolt 112 is retained in channel 118 by the upstanding block formation 121 and the inward facing surfaces 123 of post 93 defining seats 125 for springs 114. A pair of raised ribs 126 define complementary end seats 127 for springs 114. The seats 125 and 127 are normally spaced endwise from one another a distance just less than the length of springs 114.

Thus, after installation in channel 118, bolt 112 is retained vertically by flanges 104' and platform 94 and horizontally by flanges 104. Bolt 112 includes a longitudinal slot 129 therein having a width accommodating post 93 and block 121. Bolt 112 installed in channel 118 encompasses post 93 and block 121 and is longitudinally slidable in channel 118 with screw post 93 acting as a stop limiting the longitudinal reciprocal movement of the bolt 112.

Springs 114 each of a wire wound compression type, operatively mount between the slide 112 and the platform 94 best seen in FIG. 12. One end of 124 of each spring 114 abuts against an end face 126 of groove 122 while the other end 128 of spring 114 abuts against the end seats 127 of ribs 126. Platform 94 includes an upwardly facing groove 134 (see FIGS. 8 and 10) for proper seating and operation of spring 114. In operation, spring 114 maintains bolt 112 positively biased in its extended position.

Thumb slide actuator (button) 116 is molded to have a plate-like base 136 and two depending fingers 138 and 140 terminating in outwardly extending and upward facing lips 142,144 arranged transverse of the base 136 and a depending end flange 146. Slider 116 operatively mounts with fingers 138 and 140 passing through a passageway cut through the outer wall of header 40 and into aligned engagement interior of a slot 129 in bolt 112. Fingers 138 and 140 and slot 129 are dimensioned so that lip 142 is biased under the said surface 150. So biased by the outward, elastic flexure of fingers 138 and 140, the slider is engaged and retained in slot 129 for effecting reciprocal movement of bolt 112 under action of forces applied to finger flange 154 of slider 116. Effecting a reciprocal movement of slider 116, thus effects a reciprocal movement of bolt 112 for retracting same from engagement with one of said master frame jamb guide rails 36, with springs 114 acting to return bolt 112 to its extended normal position. The platform 94 and rigidifying flanges 104 and 106 serve to resist forces acting to change the right angle disposition of the legs of the support and connector member 80.

Figure 2:
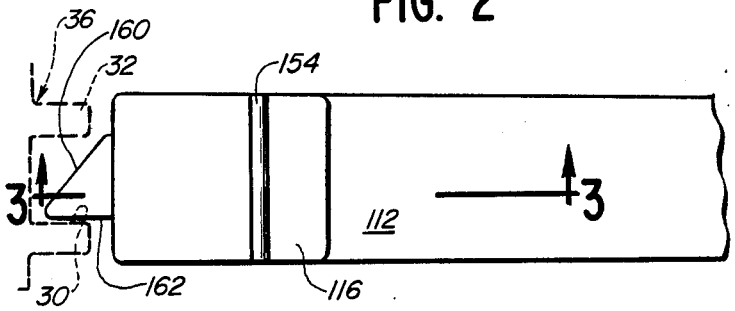
FIG. 2 is a fragmentary plan view of the latch bolt of FIG. 1.

Latch bolt 112 presents a beveled camming surface 160 and a longitudinally aligned latching surface 162. Both of surfaces 160 and 162 normally extend through and outwardly from a passageway 146 (See FIGS. 2, 3 and 4) cut through the outer wall of stile 42 near or contiguous the end thereof and aligned with bolt 112 when the joint between the header 40 and stile 42 is formed. Latching surface 162 is intended for engagement with one of the guide rails 36 (FIG. 2). Camming surface 160 is intended for engagement with jamb 26 to move bolt 112 inwardly for automatic latching of the sash when the sash is being returned to the vertical position. The upper perimeter 170 of slot 148 is beveled for aid in installation of slider fingers 140 and 142 therein. Alternatively, with post 93 acting as a stop in slot 129, or cooperatively therewith, the surface 172 of spring slot 129' opposite post 93 can act as a stop to limit extension of the bolt from stile 40.

The invention thus described by way of the preferred embodiment presents support and connector members internal of the sash frame members for supporting and connecting the members together. Further, latch means for maintaining the sash vertically are provided cooperating with the structure of the support and connector members.

Referring to FIGS. 6, 7, 8 and 9, an alternate embodiment of the invention provides a molded plastic support and connector member 230 constructed similar to member 80 and installed in the hollow formations 232 of the stile 234. Only the left-hand portions of sashes 238 are illustrated, the cross-sectional configuration of the stile being different from that shown in FIGS. 1–5. The cross-sectional configuration effects like results of inner, outer and side walls and hollow formations and are joined with the header at right-angle butt joints.

Member 230 effects the same functions of supporting and connection of the right angle butt joint between the header and the stile which is effected by members 80 although simpler in construction. Member 230 includes a plate 240 and a depending post formation 242. A spring biased latch slider 244 is sandwiched between plate 240 and a cover 246. Cover 246 is rectangular in configuration and has a top wall 248 and a pair of spaced posts 250 and 252, each carrying threaded openings 254 formed therein. A pair of locator pins 256 are suitably provided in the plate 240. The remaining top surface 258 of plate 240 is planar. The cover 246 includes the top wall 248 and depending edge flanges 262 and end flanges 264 and 266. Downwardly opening notch 268 is formed in end flange 264. A pair of blocks 270 are formed integral with the side flanges and extend outward of the cavity 272 defined by the walls or flanges 260, 262, 264 and 266. Downwardly opening sockets 274 are formed in the blocks 270 for alignment with the locator pins 256 of the plate 240 upon the assembly of the cover, latch and connector. A rectangular access slot 276 is formed in the top wall 260 between posts 250 and 252 for alignment with the locator pins 256 of the plate 240 upon assembly of the cover, slider and plate.

The slider 244 includes beveled latch formation 278 and rearwardly opening notch 280. Adjacent the end formation 278, a pair of outwardly extending coplanar rectangular formations 282 and 284 are formed integral with the slider 244. A slot 286 is formed in the slider 244 between and coextensive with the formations 282 and 284. Depending post formation 242 has a cross-sectional configuration compatible for receipt within hollow formation 232 of the stile and is force fitted therein. The cover 246 and the post 242 are fastened together by means such as self-threading screw 288 passing through opening 290 while the plate is fastened to the header 236 by screw 292, as shown in FIGS. 7 and 8. The stile 234 and header 236 also are fastened together by screw 292 passing through opening 294 of the stile 234 through passage 296 in post 242 and into the screw receiving formation 290. Channels 300 are formed in the depending post 242 to cooperate with the interior conformation within the stile 234. Bridge 302 serves as a guide for directing screw 292 into the formation 298.

A pair of wire wound springs 304 of the compression type are seated along the slider 244 on opposite sides thereof and between the respective formations 282 and 284 and the end of the slider which carries the notch 280. One end of each spring abuts the respective formation 282 or 284 while the opposite ends of the springs 304 abut the blocks 270. Thus, when installed, the slider 244 is biased outward; that is, the latch portion 278 thereof extends outward to seat within the jamb (not shown). The slider 244 is provided with integral finger 306 which protrudes through the slot 286. The slider 244 is translatable horizontally by effecting a purchase upon the finger 306 and effecting withdrawal of the latch portion 278 from the jamb.

It should be noted that the planar plate 240, when installed upon the header 236 over the right-angle joint, maintains the proper orientation of stile and header, assuring the maintenance of the right-angle at the butt joint defined between stile and header.

The invention thus described provides for a right-angle butt joined stiles and header, all the advantages of the support and connector of the copending application afforded to the mitered joints. The pivot means as described in the referenced applications in terms of the mitered joint are equally advantageously employed when the joint as a right-angle butt joint is established. The advantages of facilitated fabrication of the sash frame while rigidifying the same are likewise applicable to the type of joint herein considered.

Alternatives to the embodiments shown are possible and numerous. The cross-sectional configurations of the header and stiles can be as desired with the cross-sectional configuration of the support and connector members including latch. Pivot means can be arranged to be compatible therewith. The configurations of the latch means parts can be varied to present, such as, varying location of the screw post stop, spring, spring post and slider connection with the latch bolt. These alternatives and others are encompassed within the invention as described.

The materials of the support and connector members can be varied as desired. In one embodiment, the support and connector members, latch bolt and slider and molded from a polycarbonate material while in another embodiment they are molded from a 40% glass-filled nylon material.

Modifications and variations of the present invention thus are possible in light of the above teachings. It is therefore to be understood that within the scope of the appended claims, the invention may be practiced otherwise than as specifically described.

I claim:

1. A window sash adapted for installation in the frame of a double-hung window assembly, the window assembly frame having opposed, vertically extending guide rails to enable vertical reciprocal sliding movement of the sash in the window assembly frame while cooperatively engaged with the guide rails and a sash balance mechanism to enable pivotal movement of the sash relative to the window assembly frame while cooperatively engaged with the sash balance mechanism, the sash comprising a frame having at least a header and a pair of stiles connected together at adjacent ends, said header and stiles being extruded from a plastic material to cross-sectional configurations, the internal cross-sectional configurations of at least the stiles being identical; and the cross-sectional configurations of said stiles including at least one hollow formation therethrough opening to opposite ends thereof and the ends of said header and stiles being right-angled in their configuration to facilitate assembly into right-angled butt joints at the corners;

at least said header and stiles being connected together with right-angled butt joints with the ends of said stiles being open to expose the hollow configurations of said stiles to the exterior of said sash; and two combination support and cover members each including a depending leg segment and a cover segment arranged perpendicular to one another, the leg segment having a cross-sectional configuration complementary to that of the stiles selected to enable engagement of said leg segment in the hollow formation of a stile through the open ends thereof, the cover segment being arranged to close at least partially the open top end of a stile from exterior of said sash, the leg segment supporting said cover segment, each of said support and cover members including latch means having a latch bolt extending beyond its respective stile and adapted to engage with one of said guide rails, and means operable from external said sash frame for releasing said latch means selectively to facilitate release of the sash for pivoting of same.

2. The window sash of claim 1 in which said support and connector member includes a platform extending along one leg and rigidifying flanges upstanding and depending therefrom, there being a depending flange extending along the other leg to be engaged in a stile for receiving a fastener, the leg including means for accommodating the latch bolt for reciprocation thereof and an actuator cooperating with the latch bolt slidably for operating said latch means.

3. The window sash of claim 2 including one fastener passing through the stile and into engagement with the depending flange for fastening the stile and support and connector member together and another fastener passing through the header and platform for fastening the header to the support and connector member.

4. The window sash of claim 1 in which said support and connector members are installed internally of the pair of right-angled butted corner joints of the header and stiles and include internal latch means having a latch bolt extending resiliently outward of one of said stiles.

5. The window sash of claim 1 in which the cross-sectional configuration of each support and connector snugly fits in the hollow formations.

6. The window sash of claim 1 in which each support and connector member is "L"-shaped with the shorter of the two legs to be engaged in a stile.

7. The window sash of claim 1 in which said latch bolt is flat and elongate and is retained in a channel of said latch means defined by said platform and upstanding flanges of the other leg for reciprocal longitudinal movement therein, said latch means further including spring means and an actuating slider, said spring means being arranged between said latch bolt and support and connector member for maintaining said latch bolt in an extended position adapted to be engaged with one of said guide rails, and said actuating slider including a finger arranged externally of said header and connected to said latch bolt through the header outer wall for moving said latch bolt inwardly from said extended position to release the latch means.

8. The window sash of claim 7 in which said spring is a compression spring and is arranged between a face of a spring receiving groove in a lower surface of the latch bolt and an opposed face of a spring post upstanding from said platform.

9. The window sash of claim 7 in which said slider includes a base arranged exterior of said header from which said finger flange is upstanding and a pair of fingers depend, said fingers passing through the outer wall of said header and having terminating lips engaging with interior surfaces of at least one slot formed in said latch bolt so that forces applied longitudinally to said finger flange are transmitted to said latch bolt through the fingers.

10. The window sash of claim 9 in which said lips are arranged transverse of said slider and said lips being engaged with interior surfaces of one slot in said latch bolt.

11. The window sash of claim 7 in which the slider includes groove means for retaining said spring means.

12. In a window sash adapted for installation in the rectangular frame of a double-hung window assembly, the window assembly frame having opposed, vertically extending guide rails to enable vertical reciprocal sliding movement of the sash in the window assembly frame while cooperatively engaged with the guide rails and a sash balance mechanism to enable pivotal movement of the sash relative to the assembly frame while cooperatively engaged with the sash balance mechanism, the window sash including a sash frame including at least a header and a pair of stiles cooperatively connected at adjacent extremities thereof to form the rectangular frame, each of said header and stiles being extruded to a cross-sectional configuration from a plastic material, said cross-sectional configuration being defined by a continuous hollow formation therethrough opening to opposite ends thereof, said ends being joined in a right-angle butt joint and each stile having a passageway through a wall thereof contiguous each end thereof and opening outwardly of said sash, the herein invention comprising:

1. a combination support and connector member having a pair of leg segments arranged perpendicular to one another and of cross-sectional configuration complementary to that of the header and stiles selected to enable engagement of each leg segment in the hollow formation of the stiles to form and maintain the right-angle joints at the corners of the sash frame,
2. said support and connector member adapted to be installed internally of a corner butt joint to secure and maintain said joint; and
3. said member constructed and arranged to mount internal latch means operable from external of the header for releasing said latch means from the guide rails selectively to facilitate pivoting of the sash.

13. The combination support and connector member of claim 12 in which said latch means will include a slider carrying a latch portion at one end thereof adapted to extend through one of said passageways for engagement with a guide rail, said slider is flat and elongate and is retained in a channel of said latch means defined by a platform and flanges upstanding therefrom along one leg for reciprocal longitudinal movement therein, said latch means further including resilient means arranged between said slider and a leg segment for maintaining the latch portion in an extended position adapted to be engaged with one of said guide rails, and said actuating slider including a finger flange arranged externally of said header and connected to said latch portion through the header outer wall for moving said latch portion inwardly from said extended position to release the latch means.

14. The combination support and connector member of claim 12 in which one of said leg segments includes a planar platform resting over the stile and adjacent end of the header, a dished cover portion having a peripheral depending flange and a passage formed at one end portion of said flange, a slide sandwiched between said cover and platform for reciprocal longitudinal movement, the cover including a slot and the slide having a latch portion at one end and a finger passing through said slot, resilient means located alongside the slide and between the cover and platform for biasing the latch portion through said passage, said finger capable of being grasped for moving said latch portion inwardly from said extended position to release same from the guide rails.

15. The combination support and connector member of claim 14, said cover having depending post means for retaining the resilient means therebetween.

16. The combination support and connector member of claim 14 in which said cover includes depending fastening post means and cooperable locating means on said cover and platform, fastener means passing through said post means for securing said cover and platform together and to said header with the depending leg within said stile and the platform engaged with the header over said right-angle butt joint of said header and stile.

17. For use in framing a window sash capable of being installed in the rectangular frame of a double-hung window assembly wherein the window assembly frame has opposed, vertically extending guide rails to enable vertical reciprocal sliding movement of the sash in the window assembly frame while cooperatively engaged with the guide rails and a sash balance mechanism to enable pivotal movement of the sash relative to the assembly frame while cooperatively engaged with the sash balance mechanism, the sash frame including at least a header and a pair of stiles cooperatively connected at adjacent extremities thereof to form a rectangular frame, each of said header and stiles being extruded to a cross-sectional configuration from a plastic material, said cross-sectional configuration being defined by a continuous hollow formation therethrough opening to opposite ends thereof, said ends being joined in a right-angle butt joint and each stile having a passageway through a wall thereof contiguous each end thereof and opening outwardly of said sash, a combination support and connector member including latch means, said member having a pair of leg segments arranged perpendicular to one another, at least one of said leg segments having cross-sectional configuration complementary to that of a stile selected to enable engagement in the hollow formation of the stile to assist formation and maintenance of the right-angle joint at the corner of the sash frame, the second leg segment being configured for intimate juxtaposition, the header also for securement and maintenance of said joint and said member constructed and arranged to mount latch means operable from external of the header for releasing said latch means from the guide rails selectively to facilitate pivoting of the sash.

18. The combination support and connector member of claim 17 in which said latch means include a slider carrying a latch portion at one end thereof adapted to extend through one of said passageways for engagement with a guide rail, said slider is flat and elongate, means on said second leg segment defining a race for said slider to enable reciprocal longitudinal movement therein, said latch means further including resilient means arranged between said slider and a leg segment for maintaining the latch portion in an extended position adapted to be engaged with one of said guide rails, and said actuating slider including a finger flange arranged externally of said header and connected to said latch portion through the header outer wall for moving said latch portion along said race in a direction inwardly from said extended position to release the latch means.

19. The combination support and connector member of claim 17 in which one of said leg segments includes a planar platform resting over the stile and adjacent end of the header, a dished cover portion having a peripheral depending flange and a passage formed at one end portion of said flange, said means on said second leg defining said race cooperating with means formed on said cover, a slide sandwiched between said cover and platform for reciprocal longitudinal movement, the cover including a slot and the slide having a latch portion at one end and a finger passing through said slot, resilient means located alongside the slide and between the cover and platform for biasing the latch portion through said passage, said finger capable of being grasped for moving said latch portion inwardly from said extended position to release same from the guide rails.

20. The combination support and connector member of claim 19, said cover having depending post means for retaining the resilient means therebetween.

21. The combination support and connector member of claim 19 in which said cover includes depending fastening post means and cooperable locating means on said cover and platform, fastener means passing through said post means for securing said cover and platform together and to said header with the depending leg within said stile and the platform engaged with the header over said right-angle butt joint of said header and stile.

* * * * *